US005763022A

United States Patent [19]

Lumpp et al.

[11] Patent Number: 5,763,022

[45] Date of Patent: Jun. 9, 1998

[54] SOLVENT-RESISTANT TEXTILE BINDER

[75] Inventors: Andreas Lumpp, Burghausen; Gerhard Koegler, Burgkirchen, both of Germany

[73] Assignee: Wacker-Chemie GmbH, Munich, Germany

[21] Appl. No.: 793,320

[22] PCT Filed: Sep. 14, 1995

[86] PCT No.: PCT/EP95/03623

§ 371 Date: Mar. 12, 1997

§ 102(e) Date: Mar. 12, 1997

[87] PCT Pub. No.: WO96/08597

PCT Pub. Date: Mar. 21, 1996

[30] Foreign Application Priority Data

Sep. 15, 1994 [DE] Germany ..... 44 32 945.8

[51] Int. Cl.[6] ..... B05D 3/02

[52] U.S. Cl. ..... 427/389.9; 427/392; 427/393.1; 427/393.2; 427/393.4; 427/393.3; 428/375; 428/507; 428/522

[58] Field of Search ..... 427/389.9, 392, 427/393.1, 393.2, 393.3, 393.4; 428/375, 507, 522

[56] References Cited

U.S. PATENT DOCUMENTS

| | | | |
|---|---|---|---|
| 2,978,432 | 4/1961 | Graulia et al. . | |
| 3,240,740 | 3/1966 | Knapp et al. . | |
| 4,044,197 | 8/1977 | Wiest et al. . | |
| 4,092,303 | 5/1978 | Behrens | 260/79.5 P |
| 4,987,180 | 1/1991 | Ohata et al. | 524/860 |

FOREIGN PATENT DOCUMENTS

| | | |
|---|---|---|
| 1071883 | 8/1983 | Australia . |
| 276463 | 6/1992 | Czechoslovakia . |
| 0086889 | 8/1983 | European Pat. Off. . |
| 0261378 | 3/1988 | European Pat. Off. . |
| 0205862 | 11/1993 | European Pat. Off. . |
| 1260307 | 8/1961 | France . |
| 2003769 | 11/1969 | France . |
| 2512589 | 7/1990 | Germany . |
| 59-125972 | 7/1984 | Japan . |
| 0351940 | 3/1961 | Switzerland . |
| 9208835 | 5/1992 | WIPO . |

*Primary Examiner*—Erma Cameron
*Attorney, Agent, or Firm*—Burgess, Ryan & Ryan

[57] ABSTRACT

The invention provides a process for improving the resistance to solvents in finishing and stabilizing fiber materials with textile binders, wherein the textile binder used is an aqueous copolymer dispersion or a redispersible copolymer powder of copolymers with a $T_g$ of −60° C. to +60° C., containing (a) one or more monomer units from the group consisting of vinyl esters of unbranched or branched carboxyli acids with 1 to 12 carbon atoms, esters of acrylic acid and methacrylic acid with unbranched or branched alcohols with 1 to 12 carbon atoms, vinyl aromatics, vinyl halides and α-olefins, and (b) 0.3 to 10 wt %, relative to the total weight of the copolymer, of one or more N-(alkoxymethyl)-acrylamides or N-(alkoxymethyl)methacrylamides with a $C_1$–$C_6$ alkyl residue, or mixtures of these N-(alkoxymethyl)-meth(acrylamides with N-Methylolacrylamide and/or N-methylolmethacrylamide in a weight ratio of N-methylol compound to N-(alkoxymethyl) compound of at most 5:1.

13 Claims, No Drawings

SOLVENT-RESISTANT TEXTILE BINDER

BACKGROUND OF THE INVENTION

1) Field of the Invention

The invention relates to the use of N-(alkoxymethyl) (meth)acrylamide-functional textile binders for improving the resistance to solvents in the finishing and bonding of fiber materials, and to a process for the preparation of solvent-resistant fiber structures.

2) Background Art

The use of aqueous copolymer dispersions as binders for bonding and coating fiber structures such as woven fabrics, nonwovens and waddings of textile fiber or textile yarns is known. Copolymer dispersions of (meth)acrylate or vinyl ester copolymers which comprise self-crosslinking comonomer units with N-methylol or N-methylol ether functions to improve their strength are often used here. Up to 10% by weight of N-methylol(meth)acrylamide (NMA or NMMA) are usually copolymerized. Disadvantages of these binders are the release of formaldehyde due to hydrolytic cleavage of the N-methylol function and the low resistance to solvents of the materials bonded or coated with them. Improvement of the resistance to solvents by incorporation of precrosslinking, poly-ethylenically unsaturated comonomer units is known. However, this measure often leads to problems in the preparation of the copolymers.

Thermally self-crosslinking copolymers which comprise 2 to 10% by weight of N-methylol(meth)acrylamide or the N-methylol ether thereof are known from DE-A 2512589 (U.S. Pat. No. 4,044,197). A disadvantage is that, although in the case of the N-methylolacrylamide-containing copolymers used therein the heat-treated copolymer films show a good resistance to solvents, the nonwovens bonded with them do not.

EP-B 205862 relates to textile binders based on vinyl acetate/ethylene copolymers which comprise 1 to 5% by weight of N-methylol(meth)acrylamide units or ethers thereof. To improve the wet strength if a copolymer binder of low NMA content is used, the additional use of melamine-formaldehyde resins is proposed.

The doctrine of EP-A 261378 is to improve the heat stability of fiber mats bonded with N-methylol-functional copolymers by employing as binders those copolymers in which the N-methylol functions are completely or partly etherified.

WO-A 92/08835 describes textile binders based on vinyl acetate/ethylene copolymer emulsions which comprise exclusively N-(n-butoxymethyl)acrylamide units instead of N-methylol(meth)acrylamide units to reduce the release of formaldehyde.

EP-A 86889 (AU-A 8310718) relates to a process for the preparation of a textile coating composition which shows no white swelling and no white fracture under the action of water. The coating composition comprises an aqueous copolymer emulsion which is obtained by emulsion copolymerization of (meth)acrylates with N-methylol(meth) acrylamide, the N-methylol(meth)acrylamides being etherified to the extent of at least 20 mol % with an alcohol and the emulsion polymerization being carried out in the presence of a fatty alcohol having 10 to 20 C atoms. The resistance of textile binders to solvents is not discussed.

SUMMARY OF THE INVENTION

The invention was based on the object of providing binders based on aqueous copolymer dispersions or copolymer powders which impart to textiles finished with them a high resistance to solvents, in addition to a high dry and wet strength.

Surprisingly, this has been achieved by using, instead of N-methylol-functional copolymers, those in which some of the N-methylol functions are etherified, with which the opposite effect was rather to be expected because of the hydrophobic character of the copolymers containing N-methylol ethers.

The invention relates to the use of N-(alkoxymethyl) (meth)acrylamide-functional textile binders for improving the resistance to solvents in the finishing and bonding of fiber materials with textile binders, which comprises using as the textile binder an aqueous copolymer dispersion or a redispersible copolymer powder of copolymers having a $T_g$ of −60° C. to +60° C. comprising a) one or more monomer units from the group consisting of vinyl esters of unbranched or branched carboxylic acids having 1 to 12 C atoms, esters of acrylic acid and methacrylic acid with unbranched or branched alcohols having 1 to 12 C atoms, vinylaromatics, vinyl halides and α-olefins and b) 0.3 to 10% by weight, based on the total weight of the copolymer, of a mixture of monomer units of one or more N-(alkoxymethyl)acrylamides or N-(alkoxymethyl)methacrylamides with a $C_1$- to $C_6$-alkyl radical with N-methylolacrylamide and/or N-methylolmethacrylamide in a weight ratio of N-methylol compound to N-(alkoxymethyl) compound of not more than 5:1.

DESCRIPTION OF THE PREFERRED EMBODIMENTS

Preferred N-(alkoxymethyl) (meth)acrylamides are N-(isobutoxymethyl)acrylamide (IBMA), N-(isobutoxymethyl)methacrylamide (IBMMA), N-(n-butoxymethyl)acrylamide (NBMA) and N-(n-butoxymethyl)methacrylamide (NBMMA).

The copolymers preferably comprise 0.5 to 3.0% by weight, based on the total weight of the copolymer, of a mixture of monomer units of N-(alkoxymethyl)acrylamides or N-(alkoxymethyl)methacrylamides with a $C_1$- to $C_6$-alkyl radical with N-methylolacrylamide (NMA) and/or N-methylolmethacrylamide (NMMA). Copolymers which comprise, in the weight contents mentioned, mixtures of the N-(alkoxymethyl) (meth)acrylamides with N-methylolacrylamide or N-methylolmethacrylamide in a weight ratio of N-methylol compound to N-(alkoxymethyl) compound of 5:1 to 1:10 are particularly preferred. Copolymers which comprise 0.5 to 3.0% by weight, based on the total weight of the copolymer, of a mixture of NMA and IBMA (IBMMA) in a weight ratio of NMA/IBMA (IBMMA) of 3:1 to 1:5, in particular 1:1 to 1:5, are most preferred.

Preferred vinyl esters are vinyl acetate, vinyl propionate, vinyl butyrate, vinyl 2-ethylhexanoate, vinyl laurate, 1-methylvinyl acetate, vinyl pivalate and vinyl esters of α-branched monocarboxylic acids having 9 or 10 C atoms, for example VeoVa9® or VeoVa10® (Shell corporation's vinyl esters of versatic acids). Vinyl acetate is particularly preferred.

Preferred methacrylic acid esters or acrylic acid esters are methyl acrylate, methyl methacrylate, ethyl acrylate, ethyl methacrylate, propyl acrylate, propyl methacrylate, n-butyl acrylate, n-butyl methacrylate and 2-ethylhexyl acrylate. Methyl acrylate, methyl methacrylate, n-butyl acrylate and 2-ethylhexyl acrylate are particularly preferred.

The vinyl ester copolymers can comprise, if appropriate, 1.0 to 50% by weight, based on the total weight of the comonomer phase, of α-olefins, such as ethylene or propylene, and/or vinylaromatics, such as styrene, and/or vinyl halides, such as vinyl chloride, and/or acrylic acid esters or methacrylic acid esters of alcohols having 1 to 12 C atoms, such as methyl acrylate, methyl methacrylate, ethyl acrylate, ethyl methacrylate, propyl acrylate, propyl methacrylate, n-butyl acrylate, n-butyl methacrylate and 2-ethylhexyl acrylate, and/or ethylenically unsaturated dicarboxylic acid esters or derivatives thereof, such as diisopropyl fumarate and the dimethyl, dibutyl and diethyl esters of maleic acid or fumaric acid, or maleic anhydride. The choice from the monomers mentioned is preferably taken here such that copolymers having a glass transition temperature $T_g$ of −30° C. to +30° C. are obtained.

The (meth)acrylic acid ester copolymers can comprise, if appropriate, 1.0 to 50% by weight, based on the total weight of the comonomer phase, of α-olefins, such as ethylene or propylene, and/or vinylaromatics, such as styrene, and/or vinyl halides, such as vinyl chloride, and/or ethylenically unsaturated dicarboxylic acid esters or derivatives thereof, such as diisopropyl fumarate and the dimethyl, dibutyl and diethyl esters of maleic acid or fumaric acid, or maleic anhydride. The choice from the monomers mentioned is preferably taken here such that copolymers having a glass transition temperature $T_g$ of −30° C. to +30° C. are obtained.

If appropriate, the vinyl ester copolymers and the (meth) acrylic acid ester copolymers also comprise 0.05 to 3.0% by weight, based on the total weight of the comonomer mixture, of one or more auxiliary monomers from the group consisting of ethylenically unsaturated carboxylic acids, preferably acrylic acid or methacrylic acid, from the group consisting of ethylenically unsaturated carboxylic acid amides, preferably acrylamide and 2-acrylamidopropanesulfonic acid, from the group consisting of ethylenically unsaturated sulfonic acids and salts thereof, preferably vinylsulfonic acid, and/or from the group consisting of poly-ethylenically unsaturated comonomers, for example divinyl adipate, 1,9-decadiene, allyl methacrylate and triallyl cyanurate, and crosslinking comonomers, such as acrylamidoglycolic acid (AGA), methacrylamidoglycolic acid methyl ester (MAGME) and polyglycol dimethacrylate.

Preferred vinyl ester copolymers comprise as comonomer units a), in each case based on the total weight of the copolymer:

- 90 to 99.7% by weight of vinyl ester, in particular vinyl acetate;
- 49.7 to 89.7% by weight of vinyl ester, in particular vinyl acetate and 10 to 50% by weight of α-olefin, in particular ethylene;
- 50 to 75% by weight of vinyl acetate, 1 to 30% by weight of vinyl ester of an α-branched carboxylic acid, in particular VeoVa9® and/or VeoVa10®, and 10 to 40% by weight of ethylene;
- 70 to 98.7% by weight of vinyl acetate and 1 to 30% by weight of vinyl ester of an α-branched carboxylic acid, in particular VeoVa9® and/or VeoVa10®,
- 70 to 98.7% by weight of vinyl ester, in particular vinyl acetate, and 1 to 30% by weight of acrylic acid ester, in particular n-butyl acrylate or 2-ethylhexyl acrylate;
- 50 to 75% by weight of vinyl acetate, 1 to 30% by weight of acrylic acid ester, in particular n-butyl acrylate or 2-ethylhexyl acrylate, and 10 to 40% by weight of ethylene; or
- 30 to 75% by weight of vinyl acetate, 1 to 30% by weight of vinyl ester of an α-branched carboxylic acid, in particular VeoVa9® and VeoVa10®1 to 30% by weight of acrylic acid ester, in particular n-butyl acrylate or 2-ethylhexyl acrylate, and 10 to 40% by weight of ethylene.

Preferred (meth)acrylic acid ester copolymers comprise as comonomer units a), in each case based on the total weight of the copolymer:

- 90 to 99.7% by weight of n-butyl acrylate and/or 2-ethylhexyl acrylate;
- 40 to 59.7% by weight of methyl methacrylate and 59.7 to 40% by weight of n-butyl acrylate and/or 2-ethylhexyl acrylate; or
- 40 to 59.7% by weight of styrene and 59.7 to 40% by weight of n-butyl acrylate and/or 2-ethylhexyl acrylate.

The vinyl ester copolymers or the (meth)acrylic acid ester copolymers are preferably prepared by the emulsion polymerization process. The polymerization can be carried out discontinuously or continuously, with or without the use of seed lattices, with initial introduction of all or individual constituents of the reaction mixture, or with partial initial introduction and subsequent metering-in of the constituents or individual constituents of the reaction mixture, or by the metering process without an initial introduction. All the meterings are preferably effected at the rate of consumption of the particular component.

In a preferred embodiment, 10 to 25% by weight of comonomers a) are initially introduced and the remainder is metered in as emulsion together with comonomers b). Copolymerization with ethylene is preferably carried out under a pressure of 20 to 100 bar absolute.

The polymerization is carried out in a temperature range from 40° C. to 80° C. and is initiated using the methods usually employed for emulsion polymerization. The initiation is effected by means of the customary water-soluble agents which form free radicals, which are preferably employed in amounts of 0.01 to 1.0% by weight, based on the total weight of the monomers. Examples of these are ammonium and potassium persulfate, alkyl hydroperoxides, such as tert-butyl hydroperoxide, and hydrogen peroxide. If appropriate, the free radical initiators mentioned can also be combined in a known manner with 0.01 to 0.5% by weight, based on the total weight of the monomers, of reducing agents. Suitable reducing agents are, for example, formaldehyde-sulfoxylate salts, sodium bisulfite or ascorbic acid. In the case of redox initiation, one or both redox catalyst components are preferably metered in during the polymerization.

Dispersing agents which can be employed are all the emulsifiers and protective colloids usually used in emulsion polymerization. Preferably, 1 to 4% by weight, based on the total weight of the monomers, of emulsifier are employed. Examples of suitable emulsifiers are anionic surfactants, such as alkyl sulfates having a chain length of 8 to 18 C atoms, alkyl- and alkylaryl ether sulfates having 8 to 18 C atoms in the hydrophobic radical and up to 40 ethylene oxide or propylene oxide units, alkyl- or alkylarylsulfonates having 8 to 18 C atoms, and esters and half-esters of sulfosuccinic acid with monohydric alcohols or alkylphenols. Suitable nonionic surfactants are, for example, alkyl polyglycol ethers or alkylaryl polyglycol ethers having 8 to 40 ethylene oxide units.

If appropriate, protective colloids can be employed, preferably in amounts of up to 4% by weight, based on the total weight of the monomers. Examples of these are vinyl alcohol/vinyl acetate copolymers having a content of 80 to 100 mol % of vinyl alcohol units, polyvinylpyrrolidones having a molecular weight of 5000 to 400,000, and hydroxyethylcelluloses having a degree of substitution in the range from 1.5 to 3.

The pH range desired for the polymerization, which is in general between 3 and 7, can be established in a known manner by acids, bases or customary buffer salts, such as alkali metal phosphates or alkali metal carbonates. To establish the molecular weight, the regulators usually used, for example mercaptans, aldehydes and chlorinated hydrocarbons, can be added during the polymerization.

The solids content of the aqueous dispersions is preferably 30 to 65% by weight.

To prepare the dispersion powders, the dispersion is dried, preferably spray dried or freeze dried, particularly preferably spray dried. The known devices, such as, for example, spraying through multi-component nozzles or with a disc, in a stream of dry gas, which is heated if appropriate, can be used for this procedure. Temperatures above 250° C. are in general not used. The optimum temperature of the dry gas can be determined in a few experiments; temperatures above 60° C. have often proved to be particularly suitable.

To increase the storage stability and, for example in the case of powders of low glass transition temperature $T_g$, to prevent caking and blocking, an antiblocking agent, for example aluminum silicates, kieselguhr or calcium carbonate, is added, if appropriate, during the drying. It is furthermore also possible to add to the dispersion, if appropriate, defoamers, for example based on silicones or hydrocarbons, or spraying aids, for example polyvinyl alcohols or water-soluble melamine-formaldehyde condensation products.

In a preferred embodiment, the dispersion powders also comprise 0 to 30% by weight, particularly preferably 1 to 15% by weight, based on the base polymer, of polyvinyl alcohol having a degree of hydrolysis of 85 to 94 mol %, and/or 0 to 10% by weight of vinyl alcohol copolymers with 5 to 35% by weight of 1-methylvinyl alcohol units, and/or 0 to 30% by weight, particularly preferably 4 to 20% by weight, based on the total weight of polymeric constituents, of antiblocking agent, and, if appropriate, up to 2% by weight, based on the base polymer, of defoamer.

The aqueous copolymer dispersions and the redispersible dispersion powders are suitable for finishing and bonding of naturally occurring or synthetic fiber materials. Examples of these are wood fiber, cellulose fiber, wool, cotton, mineral fibers, ceramic fibers and synthetic fibers based on fiber-forming polymers, such as viscose fiber, polyethylene, polypropylene, polyester, polyamide, polyacrylonitrile or carbon fiber, fibers of homo- or copolymers of vinyl chloride or fibers of homo- or copolymers of tetrafluoroethylene. The aqueous copolymer dispersions and the dispersion powders are particularly suitable for finishing and bonding of cellulose fiber materials.

The invention furthermore relates to a process for the preparation of solvent-resistant fiber structures, which comprises applying an aqueous copolymer dispersion or a redispersible copolymer powder of copolymers having a $T_g$ of −60° C. to +60° C. comprising a) one or more monomer units from the group consisting of vinyl esters of unbranched or branched carboxylic acids having 1 to 12 C atoms, esters of acrylic acid and methacrylic acid with unbranched or branched alcohols having 1 to 12 C atoms, vinylaromatics, vinyl halides and α-olefins and b) 0.3 to 10% by weight, based on the total weight of the copolymer, of a mixture of one or more N-(alkoxymethyl)acrylamides or N-(alkoxymethyl) methacrylamides with a $C_1$- to $C_6$-alkyl radical with N-methylolacrylamide and/or N-methylolmethacrylamide in a weight ratio of N-methylol compound to N-(alkoxymethyl) compound of not more than 5:1, in an amount of 5 to 50% by weight of binder, based on the fiber weight, to the fiber material spread out in a flat form, and drying at a temperature of 80° to 200° C.

Before the bonding, the fibers are spread out in a flat form. The processes for this are known and depend primarily on the use to which the bonded fiber material is put. The fibers can be laid out by means of an air laying, wet laying, direct spinning or carding device. If appropriate, the flat structures can also be bonded mechanically before the bonding with the binder, for example by cross-laying, needle-punching or water jet bonding.

When used according to the invention, the aqueous copolymer dispersions are applied in the customary manner by impregnation, foam impregnation, spraying, slop padding, brushing or printing. If appropriate, after removal of excess binder by, for example, squeezing off, the textile structures are dried at temperatures of 80° to 200° C., preferably between 120° and 180° C. The amount of binder needed for bonding the fiber material is between 5 and 50% by weight of binder, based on the fiber weight, depending on the field of use.

If copolymer powders are used, in a manner known per se the pulverulent binder is sprinkled onto, sprinkled into (for example in the case of carded wadding) or compacted by vibration into the fiber material, which is prebonded mechanically if appropriate, or mixed directly with the fiber. The textile structures are dried at temperatures of 80° to 200° C., preferably between 120° and 180° C. The amount of binder needed for bonding the fiber material is between 5 and 50% by weight, based on the fiber weight, depending on the field of use.

Pigments, antioxidants, dyestuffs, plasticizers, film-forming auxiliaries, fillers, flameproofing agents, foam formation auxiliaries, foam inhibitors, wetting agents, heat sensitization agents, antistatics, biocides, agents which improve handle, additional crosslinking agents or catalysts for any necessary acceleration of the crosslinking reaction can also be added to the binder according to the invention in the amounts customary for this purpose.

The solvent-resistant textile binder is preferably suitable for bonding nonwovens, for example in the domestic and hygiene sector, and for industrial wiping cloths. Another field of use is non-slip finishing of woven fabrics.

The following examples serve to illustrate the invention further:

Preparation of the Copolymer Dispersions

Example 1

192 kg of water, 1.46 kg of a 10% strength aqueous formic acid solution, 14.7 kg of an aqueous solution of an isotridecyl ethoxylate with 15 EO units (Genapol X150) and 2.02 kg of a 25% strength aqueous solution of vinyl sulfonate were initially introduced together with 27.3 g of butyl acrylate and 17.6 kg of vinyl acetate into a pressure reactor. The mixture was heated up to 50° C. and ethylene was forced in under a pressure of 60 bar. When temperature equilibrium had been reached, a solution of 619 g of ammonium persulfate in 24.2 kg of water and a solution of 309 g of ascorbic acid in 24.5 kg of water were metered in. After the initial mixture had polymerized completely, 187 kg of vinyl acetate were metered in. After the end of the metering of vinyl acetate, a mixture of 12.6 kg of water, 10.5 kg of a 30% strength aqueous acrylamide solution, 2.4 kg of N-methylolacrylamide and 2.4 kg of N-(isobutoxymethyl) acrylamide, together with a mixture of 16.7 kg of butyl acrylate and 16.7 kg of vinyl acetate, was metered in. When the polymerization had ended, a dispersion having a solids content of 53% by weight and a copolymer composition of 11.0% of ethylene, 72.0% of vinyl acetate, 14.2% of butyl acrylate, 1.0% of acrylamide, 0.8% of N-methylolacrylamide and 0.8% of N-(isobutoxymethyl) acrylamide and 0.2% of vinyl sulfonate resulted.

Example 2 (Comparison Example)

The procedure was analogous to Example 1, with the difference that instead of the NMA/IBMA mixture, 4.8 kg of N-(isobutoxymethyl)acrylamide were copolymerized.

When the polymerization had ended, a dispersion having a solids content of 53% by weight and a copolymer composition of 11.0% of ethylene, 72.0% of vinyl acetate, 14.2% of butyl acrylate, 1.0% of acrylamide, 1.6% of N-(isobutoxymethyl)acrylamide and 0.2% of vinyl sulfonate resulted.

Example 3 (Comparison Example)

The procedure was analogous to Example 1, with the difference that only N-methylolmethacrylamide and no N-(isobutoxymethyl)acrylamide was used.

After the end of the polymerization, a dispersion having a solids content of 53% by weight and a copolymer composition of 11.0% of ethylene, 72.0% of vinyl acetate, 14.2% of butyl acrylate, 1.0% of acrylamide, 1.6% of N-methylolacrylamide and 0.2% of vinyl sulfonate resulted.

Example 4

542 g of water, 0.5 g of a 10% strength aqueous Fe(II) sulfate solution, 11.9 g of an aqueous solution of an ethylene oxide/propylene oxide block copolymer (Genapol PF40) and 3.1 g of a 25% strength aqueous solution of vinyl sulfonate, together with 8.2 g of butyl acrylate and 70.5 g of vinyl acetate, were initially introduced into a laboratory reactor. The mixture was heated up to 45° C. When temperature equilibrium had been reached, a solution of 9.8 g of ammonium persulfate in 187 g of water and a solution of 4.9 g of Rongalite in 192 g of water were metered in. After the initial mixture had polymerized completely, 776 g of vinyl acetate and 39.6 g of butyl acrylate were metered in. When the metering of the vinyl acetate/butyl acrylate had ended, a mixture of 86 g of water, 9.21 g of acrylic acid, 20.7 g of N-methylolacrylamide and 9.9 g of N-(isobutoxymethyl) acrylamide, together with 76.8 g of a 40% strength aqueous solution of an isotridecyl ethoxylate with 15 EO units (Genapol X150) and 21.9 g of a 28% strength aqueous solution of a sulfated alkyl ethoxylate with about 3 EO units (Genapol ZRO), was metered in.

When the polymerization had ended, a dispersion having a solids content of 50% by weight and a copolymer composition of 91.0% of vinyl acetate, 5.1% of butyl acrylate, 1.7% of N-methylolacrylamide, 0.8% of N-(isobutoxymethyl)acrylamide, 1.0% of acrylic acid and 0.01% of vinyl sulfonate resulted.

Example 5 (Comparison Example)

The procedure was analogous to Example 4, with the difference that only N-methylolmethacrylamide and no N-(isobutoxymethyl)acrylamide was used.

When the polymerization had ended, a dispersion with a solids content of 50% by weight and a copolymer composition of 91.0% of vinyl acetate, 5.1% of butyl acrylate, 2.5% of N-methylolacrylamide, 1.0% of acrylic acid and 0.01% of vinyl sulfonate resulted.

Use Tests

Production of the Nonwovens

To produce the nonwovens, a viscose staple fiber nonwoven was bonded with 20% by weight of copolymer dispersion (solids, based on the fiber) by means of full bath impregnation. The excess binder was squeezed off between two rolls and the nonwoven was dried in a drum drier at 150° C. for 3 minutes.

Determination of the Strength of the Nonwovens in Accordance with DIN 53857

The dry strength, wet strength and resistance to solvents of the nonwovens was determined by means of measurement of the maximum tensile force (MTF) of strips of nonwoven with a width of 1.5 cm and a length of 15 cm. Before the measurement, the nonwovens were kept in a standard climate at T=23° C. and 50% relative atmospheric humidity (DIN 50014) for at least 24 hours.

To determine the wet strength, the nonwovens were kept in water for 1 minute immediately before the measurement. To determine the resistance to solvents, the nonwovens were kept in isopropanol for 1 minute immediately before the measurement.

The maximum tensile force was measured with a Zwick tensile tester, the tensile measurement being carried out at a constant rate of elongation of 100 mm/minute. For each measurement, the maximum tensile force is determined and the measurement is ended when the force has fallen to 40% of the maximum tensile force. In each case 5 strips of nonwoven per specimen were clamped jointly. The mean of two measurement series was determined.

The results of the measurements are summarized in Table 1:

TABLE 1

| Example | NMA (%) | IBMA (%) | MTF (N) dry | MTF (N) wet | MTF (N) isopropanol |
|---|---|---|---|---|---|
| 1 | 0.8 | 0.8 | 20.4 | 9.5 | 8.5 |
| 2* | 0 | 1.6 | 19.1 | 8.4 | 8.1 |
| 3* | 1.6 | 0 | 19.1 | 9.2 | 5.1 |
| 4 | 1.7 | 0.8 | 25.5 | 11.3 | 13.3 |
| 5* | 2.5 | 0 | 23.0 | 10.2 | 10.0 |

*Comparison examples

We claim:

1. A process for improving the resistance to solvents of fiber materials bonded or coated with an aqueous copolymer dispersion or a redispersible powder, which comprises finishing and bonding the fiber materials with an N-(alkoxymethyl) (meth)acrylamide-functional textile binder comprised of an aqueous copolymer dispersion or a redispersible copolymer powder of copolymers having a $T_g$ of −60° C. to +60° C. comprising a) one or more monomer units selected from the group consisting of vinyl esters of unbranched carboxylic acids having 1 to 12 C atoms, esters of acrylic acid and methacrylic acid with unbranched or branched alcohols having 1 to 12 C atoms, vinylaromatics, vinyl halides and α-olefins and b) 0.3 to 10% by weight, based on the total weight of the copolymer, of a mixture of monomer units of one or more N-(alkoxymethyl)acrylamides or N-(alkoxymethyl)methacrylamides having $C_1$- to $C_6$-atoms in the alkoxy radical with N-methylolacrylamide and/or N-methylolmethacrylamide in a weight ratio of the N-methylol compound to the N-(alkoxymethyl) compound of not more than 5:1.

2. The process as claimed in claim 1, wherein the copolymer comprises 0.5 to 3.0% by weight, based on the total weight of the copolymer, of a mixture of N-(alkoxymethyl) (meth)acrylamides with N-methylolacrylamide or N-methylolmethacrylamide in a weight ratio of N-methylol compound to N-(alkoxymethyl) compound of 5:1 to 1:10.

3. The process as claimed in claim 1 wherein the copolymer is selected from the group consisting of N-(isobutoxymethyl)acrylamide (IBMA), N-(isobutoxymethyl) methacrylamide (IBMMA), N-(n-butoxy-methyl)acrylamide (NBMA) and N-(n-butoxymethyl)methacrylamide (NBMMA) as N-(alkoxymethyl) (meth)acrylamides.

4. The process as claimed in claim 3, wherein the copolymer comprises 0.5 to 3.0% by weight, based on the total weight of the copolymer, of a mixture of N-methylolacryl amide (NMA) and either N-(isobutoxymethyl)acrylamide (IBMA) or N-(isobutoxymethyl)methacrylamide (IBMMA) wherein the weight ratio of NMA/IBMA (IBMMA) is 3:1 to 1:5.

5. The process as claimed in claim 1 wherein the vinyl ester copolymer of comonomer units a), in each case based on the total weight of the copolymer, is selected from the group consisting of:

(1) 90 to 99.7% by weight of vinyl ester;

(2) 49.7 to 89.7% by weight of vinyl ester, and 10 to 50% by weight of an α-olefin;

(3) 50 to 75% by weight of vinyl acetate, 1 to 30% by weight of vinyl ester of an α-branched carboxylic acid, and 10 to 40% by weight of ethylene;

(4) 70 to 98.7% by weight of vinyl acetate and 1 to 30% by weight of vinyl ester of an α-branched carboxylic acid;

(5) 70 to 98.7% by weight of a vinyl ester, and 1 to 30% by weight of an acrylic acid ester;

(6) 50 to 75% by weight of vinyl acetate, 1 to 30% by weight of acrylic acid ester, and 10 to 50% by weight of ethylene; and (7) 30 to 75% by weight of vinyl acetate, 1 to 40% by weight of a vinyl ester of an α-branched carboxylic acid, 1 to 30% by weight of an acrylic acid ester, and 10 to 40% by weight of ethylene.

6. The process as claimed in claim 1 wherein a (meth) acrylic acid ester copolymer which comprises as comonomer units a), in each case based on the total weight of the copolymer, is a member selected from the group consisting of 90 to 99.7% by weight of n-butyl acrylate and/or 2-ethylhexyl acrylate; 40 to 59.7% by weight of methyl methacrylate and 59.7 to 40% by weight of n-butyl acrylate and/or 2-ethylhexyl acrylate; and 40 to 59.7% by weight of styrene and 59.7 to 40% by weight of n-butyl acrylate and/or 2-ethylhexyl acrylate.

7. A process for the preparation of a solvent-resistant fiber structure, which comprises applying an aqueous copolymer dispersion or a redispersible copolymer powder of copolymers having a $T_g$ of −60° C. to +60° C. comprising a) one or more monomer units selected from the group consisting of vinyl esters of unbranched or branched carboxylic acids having 1 to 12 C atoms, esters of acrylic acid and methacrylic acid with unbranched or branched alcohols having 1 to 12 C atoms, vinylaromatics, vinyl halides and α-olefins and b) 0.3 to 10% by weight, based on the total weight of the copolymer, of a mixture of one or more N-(alkoxymethyl)acrylamides or N-(alkoxymethyl) methacrylamides having $C_1$- to $C_6$-atoms in the alkoxy radical with N-methylolacrylamide and/or N-methylolmethacrylamide in a weight ratio of N-methylol compound to N-(alkoxymethyl) compound of not more than 5:1, in an amount of 5 to 50% by weight of binder, based on the fiber weight, to the fiber material spread out in a flat form, and drying at a temperature of 80° to 200° C.

8. The solvent resistant fiber structure prepared by the process of claim 7.

9. The process of claim 5 wherein in (1), (2) and (5), the vinyl ester is vinyl acetate.

10. The process of claim 5 wherein in (2), the α-olefin is ethylene.

11. The process of claim 5, wherein in (3), (4) and (7), the α-branched carboxylic acid is a mixture of $C_{10}$ saturated monocarboxylic acid isomers.

12. The process of claim 5, wherein in (3), (4) and (7), the α-branched carboxylic acid is a mixture of $C_9$ saturated monocarboxylic acid isomers.

13. The process of claim 5 wherein in (6) and (7), the acrylic acid ester is N-butyl acrylate or 2-ethylhexyl acrylate.

* * * * *